US006397870B1

(12) United States Patent
Makedonsky et al.

(10) Patent No.: US 6,397,870 B1
(45) Date of Patent: Jun. 4, 2002

(54) PORTABLE ICE FISHING SHELTER

(76) Inventors: James Makedonsky; Peggy L. Makedonsky, both of 1571 Lincolnshire Dr., Lapeer, MI (US) 48446

( * ) Notice: Subject to any disclaimer, the term of this patent is extended or adjusted under 35 U.S.C. 154(b) by 0 days.

(21) Appl. No.: 09/723,071

(22) Filed: Nov. 27, 2000

(51) Int. Cl.[7] ..... E04H 15/56
(52) U.S. Cl. ..... 135/116; 135/901
(58) Field of Search ..... 135/901, 121, 135/128, 132, 133, 137, 143, 116; 114/351, 361

(56) References Cited

U.S. PATENT DOCUMENTS 3,570,507 A * 3/1971 Kashuba ..... 135/901
3,971,395 A * 7/1976 Lipinski ..... 135/901
4,084,597 A 4/1978 Compton
4,239,247 A 12/1980 Hinz
4,438,940 A * 3/1984 Hunt ..... 297/194
4,585,020 A * 4/1986 Masuda ..... 135/901
4,796,649 A * 1/1989 Tolomay ..... 135/901
4,870,984 A * 10/1989 Roth ..... 135/90
4,926,893 A * 5/1990 Klopfenstein ..... 135/901
4,938,243 A * 7/1990 Foster ..... 135/901
5,133,378 A * 7/1992 Tanasychuk ..... 135/901
5,271,423 A * 12/1993 Eychaner ..... 135/901
5,341,588 A * 8/1994 Lizotte ..... 135/901
5,368,057 A 11/1994 Lubkeman et al.
5,458,079 A * 10/1995 Matthews ..... 135/901
5,622,198 A * 4/1997 Elsinger ..... 135/128
5,678,346 A * 10/1997 Kellett ..... 134/901
5,749,387 A 5/1998 Thompson

* cited by examiner

*Primary Examiner*—Beth A. Stephan
(74) *Attorney, Agent, or Firm*—Henderson & Sturm LLP

(57) ABSTRACT

A portable ice fishing shelter construction including a hull member having a floor provided with exterior sidewalls and a centrally offset enlarged aperture dimensioned to receive the lower torso of an occupant and surrounded by raised interior sidewalls which define an interior well within the hull member, wherein the raised interior sidewalls are provided with a pair of handle members for lifting and carrying the hull member while being surrounded thereby; and, wherein the hull member is further provided with a collapsible cover unit.

18 Claims, 3 Drawing Sheets

PORTABLE ICE FISHING SHELTER

CROSS REFERENCE TO RELATED APPLICATIONS

Not applicable.

BACKGROUND OF THE INVENTION

1. Field of the Invention

The present invention relates to the field of portable ice fishing shelters in general and in particular to an ice fishing shelter that can be transported by a person disposed within the confines of the shelter.

2. Description of Related Art

As can be seen by reference to the following U.S. Pat. Nos. 5,368,057; 4,084,597; 4,239,247; and 5,749,387, the prior art is replete with myriad and diverse portable ice fishing shelters.

While all of the aforementioned prior art constructions are more than adequate for the basic purpose and function for which they have been specifically designed, they are uniformly deficient with respect to their failure to provide a simple, efficient, practical and safe portable shelter that can be transported to and from a fishing spot from within the confines of the portable shelter.

As most people who engage in ice fishing are all too well aware, variable ice conditions represent a very real and potential deadly danger that every year claims the lives of several participants in this otherwise enjoyable sport.

In addition, none of the prior art portable shelter constructions are specifically designed to keep the occupant of the shelter afloat when faced with catastrophic ice failure.

As a consequence of the foregoing situation, there has existed a longstanding need for a new and improved type of portable ice fishing shelter that provides a safe and secure buoyant shelter that substantially envelops the occupant of the shelter during transportation while virtually insuring that the occupant will not fall through thin spots in the ice while transporting the shelter; and, the provision of such a construction is the stated objective of the present invention.

BRIEF SUMMARY OF THE INVENTION

Briefly stated, the portable ice fishing shelter construction that forms the basis of the present invention comprises in general a hull unit, a cover unit installed on the hull unit and a transport unit operatively associated with the hull unit.

As will be explained in greater detail further on in the specification, the hull unit includes a hull member having a floor surrounded by raised exterior sidewalls and further provided with an enlarged aperture dimensioned to receive the lower torso of an adult person; wherein, the enlarged aperture is surrounded by raised interior sidewalls whose height matches the height of the exterior sidewalls to define an interior well within the hull member.

In addition, the cover unit includes two mirror image shelter member halves pivotally connected proximate the midpoint of opposed sides of the hull member wherein the shelter halves each include a fabric covering that is attached along one edge to the periphery of one half of the hull member and having another edge that is affixed to a pivoted framework element.

Furthermore, the transport unit includes a pair of handle members that are affixed to the hull member so that the occupant can step into the well within the hull member and grasp the handles to lift and transport the portable shelter construction from one location to another.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
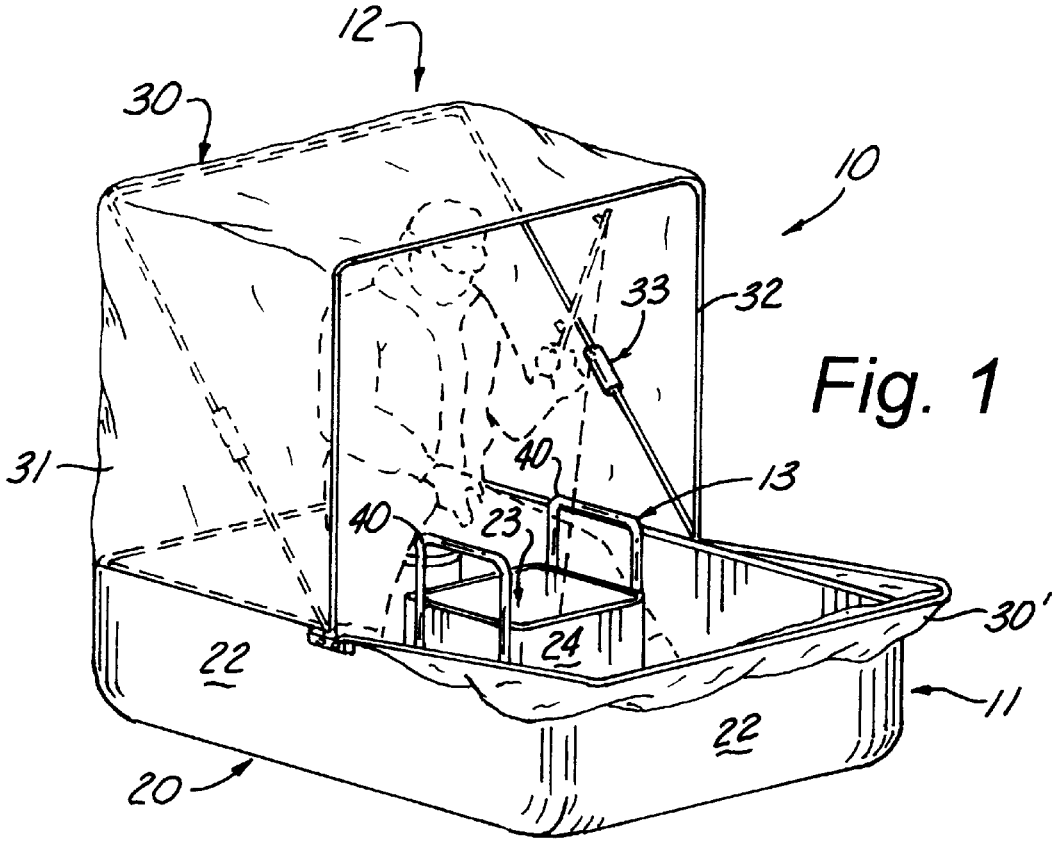
FIG. 1 is a perspective view of the shelter construction with one of the shelter halves in the open position.

As can be seen by reference to the drawings, and in particular to FIG. 1, the portable ice fishing shelter construction that forms the basis of the present invention is designated generally by the reference number 10. The construction 10 comprises in general a hull unit 11, a cover unit 12 and a transport unit 13. These units will now be described in seriatim fashion.

Figure 2:
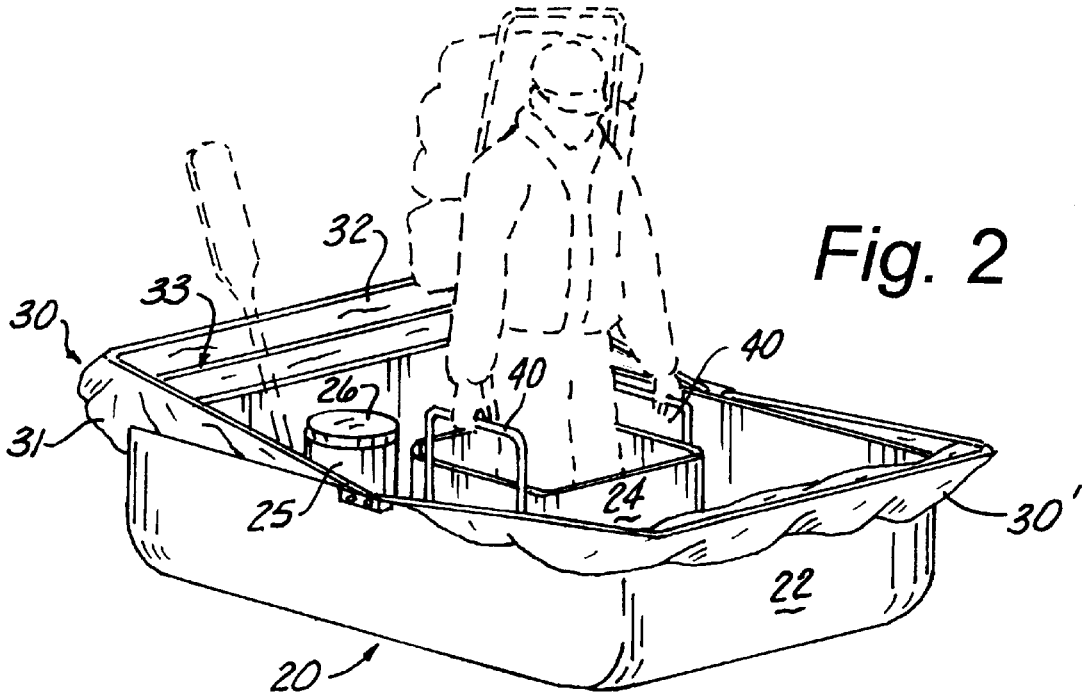
FIG. 2 is a perspective view illustrating how the occupant would transport the construction from one location to another.
Figure 3:
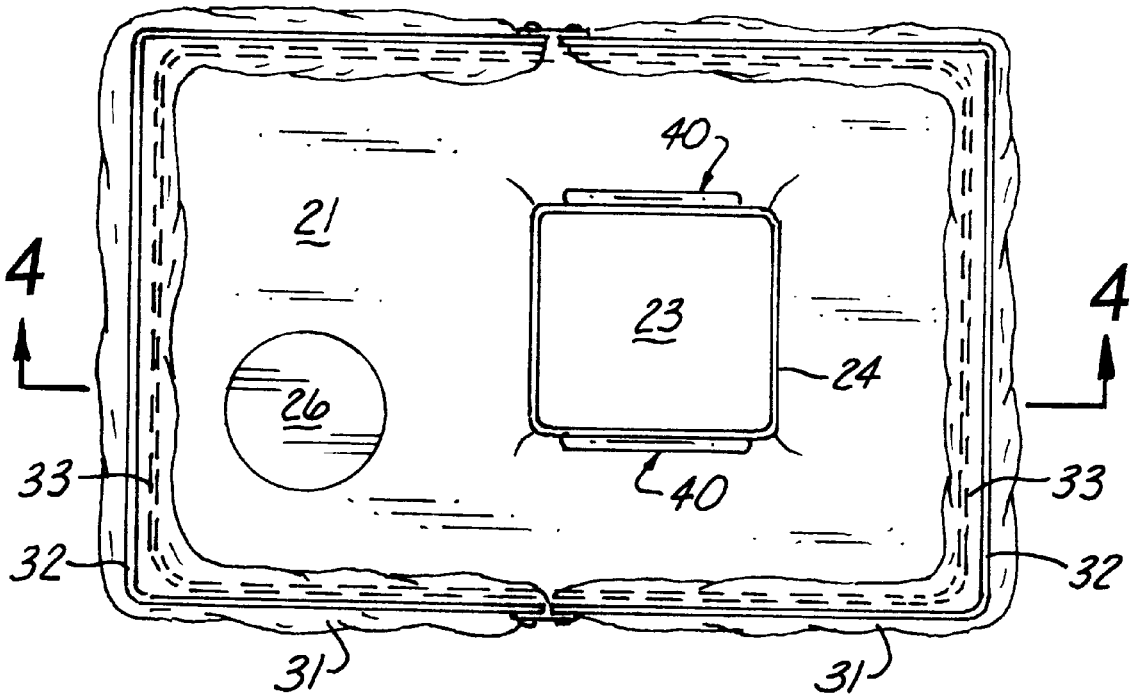
FIG. 3 is a top plan view of the shelter construction.
Figure 4:
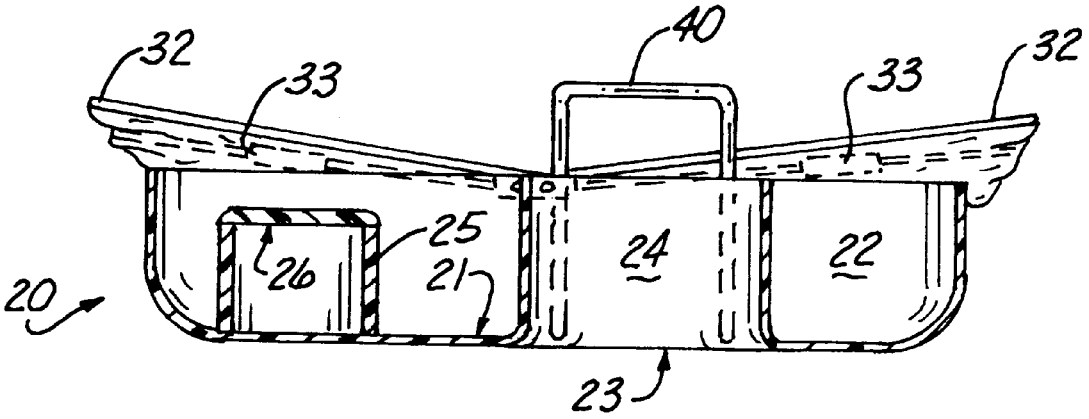
FIG. 4 is a cross-sectional view taken through line 4—4 of FIG. 3.
Figure 5:
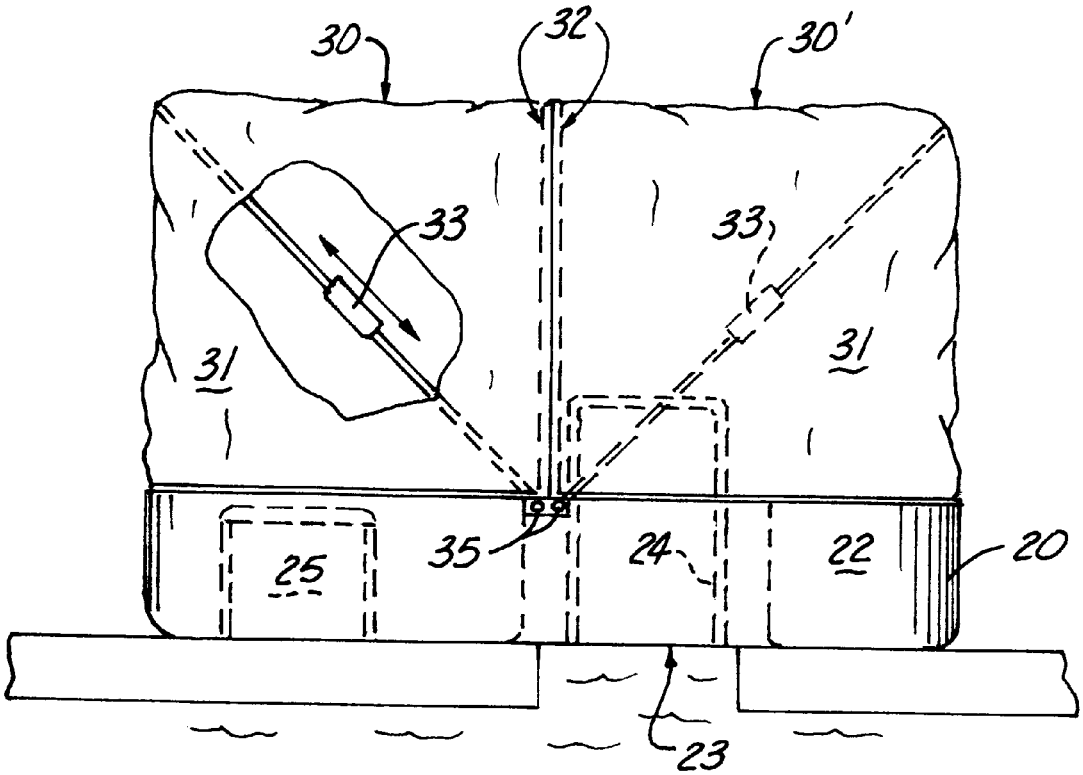
FIG. 5 is a cut away side elevation view showing one of the collapsible framework elements.
Figure 6:
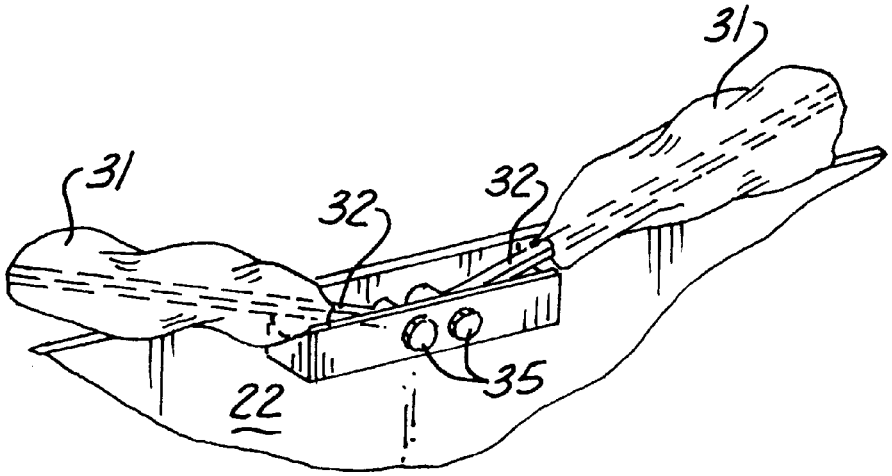
FIG. 6 is a detailed view of the pivoted storage position of the shelter halves.

As can best be seen by reference to FIGS. 2 through 4, the hull unit 11 comprises a one-piece hull member 20 having a floor 21 surrounded by raised exterior sidewalls 22; wherein the floor 21 is further provided with a centrally offset enlarged aperture 23 that is dimensioned to receive the lower torso of an adult and is further surrounded by raised interior sidewalls 24 that define an interior well within the hull member 20.

In addition, as shown in FIGS. 3 and 4, the hull member 20 is further provided with a generally hollow cylindrical storage element 25 which projects upwardly from the floor 21 of the hull member 20 and is further provided with a lid element 26 that serves as a seat for the occupant of the shelter construction 10.

As shown in FIGS. 1 through 6, the cover unit 12 comprises two mirror image shelter member halves 30, 30' wherein each shelter member half 30 includes a fabric cover 31 operatively associated with a fixed length inverted U-shaped framework element 32 and an adjustable length inverted U-shaped framework element 33 wherein each of the framework elements 32, 33 are pivotally connected as at 35 on their lower ends proximate the midpoint of the raised exterior sidewalls 22 on opposite sides of the hull member 20.

In addition, the lower fabric cover 31 has one continuous peripheral edge fixedly secured to the top of the raised sidewalls on one end of the hull member 20 and the other peripheral edge fixedly secured to the fixed length pivoted framework element 32 in a well recognized fashion to provide a quickly erectable sheltered enclosure for the construction 10.

Still referring to FIGS. 1 through 4, it can be seen that the transport unit 13 includes a pair of handle members 40 operatively associated with a pair of opposed interior raised sidewalls 24 to allow the occupant to step inside the interior well in the hull member 20 and by grasping the handle members 40 and standing up to transport the shelter construction from place to place while being surrounded by the hull member 20.

As a consequence of the foregoing situation, should the occupant of the construction 10 encounter thin ice, only the lower portions of their legs are likely to be submerged before they are able to arrest their descent through the enlarged hull aperture 23 and regain access to the safety of the floor 21 of the hull member 20.

It should also be noted at this juncture that the raised interior sidewalls 24 are the same height as the exterior sidewalls 22 to not only prevent water from entering into the hull member 20 but also to eliminate glare and allow the user to see down into the depths on sunny days when the shelter halves 30, 30' are in their open position.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A portable ice fishing shelter construction comprising:

a hull unit including a hull member having a floor provided with an enlarged aperture dimensioned to receive the lower torso of a person and further including raised exterior sidewalls that surround the exterior of the floor of the hull member; and means for lifting and carrying the hull member while the lower torso of a person is disposed within said enlarged aperture.

2. The construction as in claim 1, wherein the hull member further includes raised interior sidewalls spaced from said raised exterior sidewalls and disposed in a surrounding relationship relative to said enlarged aperture.

3. The construction as in claim 2, wherein the height of the raised interior sidewalls are approximately equal to the height of the raised exterior sidewalls.

4. The construction as in claim 2, wherein said enlarged aperture is disposed in a centrally offset fashion relative to the floor of the hull member.

5. The construction as in claim 3, wherein said enlarged aperture is disposed in a centrally offset fashion relative to the floor of the hull member.

6. The construction as in claim 2 further comprising a cover unit including two mirror image shelter member halves operatively connected to the raised exterior sidewalls.

7. The construction as in claim 6, wherein each of the shelter member halves includes a fabric cover and at least one framework element pivotally connected to the hull member.

8. The construction as in claim 6, wherein each of the shelter member halves includes a fabric cover connected to a fixed length framework element associated with the hull member.

9. The construction as in claim 6, wherein each of the shelter member halves includes a fabric cover operatively associated with an adjustable length framework element connected to the hull member.

10. The construction as in claim 6, wherein each of the shelter member halves includes a fabric cover operatively associated with both a fixed length and an adjustable length framework element connected to the hull member.

11. The construction as in claim 2, wherein the hull member further includes a hollow storage element that projects upwardly from the floor of the hull member.

12. The construction as in claim 11, wherein the storage element is further provided with a lid element.

13. The construction as in claim 6, wherein the hull member further includes a hollow storage element that projects upwardly from the floor of the hull member.

14. The construction as in claim 13, wherein the storage element is further provided with a lid element.

15. The construction as in claim 2, wherein said means for lifting and carrying the hull member comprises a pair of handle members connected to the hull member in the proximity of said enlarged opening.

16. The construction as in claim 6, wherein said means for lifting and carrying the hull member comprises a pair of handle members connected to the hull member in the proximity of said enlarged opening.

17. The construction as in claim 15, wherein the handle members are connected to said raised interior sidewalls.

18. The construction as in claim 16, wherein the handle members are connected to said raised interior sidewalls.

* * * * *